US005875848A

United States Patent [19]

Wolff et al.

[11] Patent Number: 5,875,848

[45] Date of Patent: Mar. 2, 1999

[54] WEIGHT MANAGEMENT SYSTEM AND METHOD FOR MARINE DRILLING RISER

[75] Inventors: Christian V. Wolff, Houston; Drew A. Weathers, Katy, both of Tex.

[73] Assignee: Reading & Bates Development Co., Houston, Tex.

[21] Appl. No.: 837,249

[22] Filed: Apr. 10, 1997

[51] Int. Cl.[6] ..... E21B 19/09

[52] U.S. Cl. ..... 166/345; 166/367

[58] Field of Search ..... 166/359, 330, 166/367, 356, 339, 345

[56] References Cited

U.S. PATENT DOCUMENTS

| | | | |
|---|---|---|---|
| 3,815,673 | 6/1974 | Bruce et al. | 166/359 |
| 4,495,999 | 1/1985 | Sykora | 166/364 |
| 4,557,332 | 12/1985 | Denison et al. | 166/359 X |
| 4,682,913 | 7/1987 | Shatto et al. | 166/344 X |
| 4,712,620 | 12/1987 | Lim et al. | 166/355 |
| 5,676,209 | 10/1997 | Reynolds | 166/339 |

*Primary Examiner*—Frank S. Tsay
*Attorney, Agent, or Firm*—Pravel, Hewitt & Kimball

[57] ABSTRACT

A system and a method are provided for managing the weight of an underwater riser assembly. The system includes a blocking mechanism for selectively blocking the bottom end of the riser assembly so that heavy drilling mud is retained within the riser assembly. Upper and lower flooding valves are located in the riser assembly above the blocking mechanism and are spaced apart. The valves can be opened so that an annulus in the riser assembly is in fluid communication with surrounding water. Drilling fluid can be introduced to or removed from the annulus during deployment or disconnect conditions using the upper and lower flooding valves. For the blocking mechanism, an elongated cylindrical tool can fill the annulus at the bottom end of the riser assembly to block fluid flow in the annulus.

13 Claims, 4 Drawing Sheets

WEIGHT MANAGEMENT SYSTEM AND METHOD FOR MARINE DRILLING RISER

FIELD OF THE INVENTION

This invention relates to marine drilling risers and, more particularly, to a management system and method for adjusting the weight of the lower portion of a riser assembly under deployment or disconnect operations.

BACKGROUND OF THE INVENTION

Drilling operations offshore from a floating vessel require the deployment, use and disconnect of marine drilling riser. The riser is a conduit and containment vessel for the drill string, drilling fluids and cuttings from the well, and for well gas that may need to be diverted in well control operations.

At the sea bottom, the lower end of the riser is connected to a lower flex joint or ball joint which is part of a mechanism called the Lower Marine Riser Package (LMRP), which in turn is connected at the top of a Ram-type blow out preventer (BOP) that is mounted on top of the wellhead connector. The riser assembly is connected at its upper end to the drilling vessel by way of a telescoping or slip joint and an upper flex or ball joint, to a diverter housing which is located below the drill floor of the vessel.

Marine risers are well known. They are made up of multiple sections of large diameter steel tubes (Marine Riser) that are joined with special connectors. The riser usually supports what are called the kill and choke lines, mud booster line, and other ancillary lines that are connected from the drilling vessel to the wellhead connector.

The drilling riser may be equipped with buoyancy modules of a known type which are either filled with syntactic foam or are hollow vessels that can be filled with air to adjust the buoyancy of the riser. The riser is typically tensioned at the top and connected to the drilling vessel by way of a telescoping slip joint. The slip joint permits relative vertical movement of the drilling vessel with respect to the stationary tensioned riser. Horizontal movement of the riser is facilitated by means of the ball or flex joints.

When the drilling riser is deployed and connected, it is affected and stressed by different interacting forces including its own weight, its top tension, the weight of the drilling fluid, the wave and current action in the water, and the horizontal excursions or movements of the drilling vessel. The riser must be designed to withstand all of these forces in a safe and effective way under normal and extreme conditions.

When the drilling vessel is caused to move by wave and current action greater than normal because of bad weather, a larger riser angle relative to the drilling vessel and/or BOP results causing significant tension and bending stresses due to the weight of the riser and drilling fluid contained in it. The buoyancy modules are provided to mitigate these stresses by reducing the effective weight of the riser in water and even create a positive buoyancy condition.

During deployment or recovery, the riser string is run in an open mode through the diverter housing, which means that there is free flooding in the riser for equalizing the pressure both inside and outside of the riser. During this time, the riser string is hanging freely, either from a derrick or from a spider on the rotary table on the drilling rig. Joints are added to the top of the riser by way of special connectors. Movement of the drilling vessel, as well as wave and current action, act on the hanging riser that is being deployed. Because of the attached buoyancy modules, the riser has an effectively low weight, but a relatively large mass.

This imbalance of mass and weight can lead to severe complications during deployment or when hung-off in very deep water, for example, water depths of greater than 5,000, up to and beyond 10,000 feet, in extreme conditions caused by bad weather. The vessel heaves or moves up and down in the water inducing vertical motion at the top of the riser. This up and down movement can result in severe compressive budding and failure.

Attempts to solve these problems in the past include any one or a combination of different methods of maintaining weight in the lower portion of the riser, but at the same time keeping the weight at a minimum in the upper portion of the riser. One attempt was to increase the thickess and therefore the weight of the lower riser tube. Another consideration was to add an artificially heavy weight, such as spent uranium or the like, to the LMRP. Other attempts included reducing buoyancy at the bottom of the riser string while increasing buoyancy at the top of the riser string, or increasing riser tube thickness. Another method used was to equip riser joints with air-can buoyancy at the lower part of the riser which will add to the weight of the lower part of the riser until air is introduced into the buoyancy modules from a vessel-based, high pressure generator system.

All of these systems have proved to be either more costly or time-consuming than desirable. Thus, there is a need in the industry for an inexpensive and easily operable system and method for adjusting the weight of a riser assembly at the lower end during deployment or disconnect conditions.

SUMMARY OF THE INVENTION

The problems discussed above have been solved by the system and method for managing the weight of an underwater riser assembly described in greater detail below. In general terms, the system includes a blocking mechanism for selectively blocking the bottom end of the riser assembly and thus retaining the heavier drilling mud. Upper and lower flooding valves, which are independently operable, are located in spaced-apart positions in the riser assembly above the blocking mechanism. The valves are adapted to selectively operate in an open position for communicating the riser annulus with the surrounding water and a closed position for closing that communication. A mechanism for introducing or removing heavy fluid from the riser annulus during various open and closed positions of the upper and lower flooding valves under deployment or disconnect conditions is also provided.

The blocking mechanism can include an elongated cylindrical tool adapted to substantially fill the annulus at the bottom end of the riser assembly for blocking the flow of fluid in the annulus. The blocking mechanism can also include a bottom closure assembly attached to the bottom end of the riser assembly, which includes an annular preventer that will apply pressure around the cylindrical tool located within the annular for pushing the annular element against the tool and preventing fluid from flowing through the annulus. The blocking mechanism can also include a blind ram or other suitable mechanism for blocking flow of fluid in the riser annulus.

The lower flooding valve is mounted immediately above the closing mechanism. The upper flooding valve is mounted in the riser assembly a predetermined distance between the subsea floor and the surface of the water, in some circumstances approximately one-third of that distance. The upper and lower flooding valves can be changed from their open and closed positions by a remotely operable actuator system, or they can be changed by a remotely operable vehicle (ROV).

The mechanism for introducing and removing heavy fluid in the form of drilling mud includes a riser cap assembly with an opening adapted for connection with a mud booster line for communication with the annulus of the riser assembly. The mud booster line can be connected to the mud pump manifold. A mud return line can be connected at the upper end of the mud booster line to displace the mud with sea/drill water.

A method for managing the weight of a marine drilling riser includes providing the upper and lower valves described above, selectively blocking the annulus below the lower valve, and introducing heavy fluid such as drilling mud into the annulus between the upper and lower valves under predetermined conditions.

When the riser is being deployed, the lower valve is installed on a first riser joint and the annulus is blocked. The riser string is then run a predetermined distance with the lower valve open, at which time the upper valve is installed on the drill string.

Heavy fluid is then introduced into the annulus via the booster line, displacing sea water, with the lower valve closed and the upper valve open, until the heavy fluid reaches a point below the upper valve.

The riser string is then run with the upper valve open until the bottom of the riser is connected to the wellhead. Heavy fluid is then introduced into the annulus via the booster line or drill pipe, displacing sea water, after the upper valve is closed, until a column of fluid is established. The annulus below the lower valve is then unblocked so that normal drilling operations can take place.

The method of retrieving the riser assembly in accordance with the present invention includes the steps of blocking the annulus below the lower valve and then displacing drilling fluid from the annulus above the upper valve with sea water with the upper and lower valves closed. After the riser assembly is disconnected from the wellhead, the riser string is retrieved with the upper valve open until the upper valve reaches the drilling platform. Heavy fluid between the upper and lower valves is displaced with sea water, with the lower valve closed. The remaining riser string is retrieved with the lower valve open.

In an emergency situation, the annulus below the lower valve is blocked and the LMRP is disconnected from the underground well. At that time, heavy fluid is removed from the annulus above the upper valve and the upper and lower valves are closed.

The invention, as described in general terms, solves the problems discussed above by allowing an operator to adjust the weight of the riser assembly under various conditions.

BRIEF DESCRIPTION OF THE DRAWINGS

A better understanding of the invention can be obtained when a detailed description of an exemplary embodiment set forth below is considered in conjunction with the appended drawings, in which.

DETAILED DESCRIPTION OF AN EXEMPLARY EMBODIMENT

FIGS. 1–7 illustrate an exemplary embodiment of the riser management system and method of the present invention. The management system and method, in general terms, are used to adjust the weight of the lower portion of a riser assembly during deployment or disconnect conditions.

Marine risers for underwater drilling operations are well known. They include a conduit or annulus for returning drilling fluids and cuttings from an underwater well and for well gas that may need to be diverted in well-controlled operations. A drill string (not shown) is run within the riser.

Figure 1:
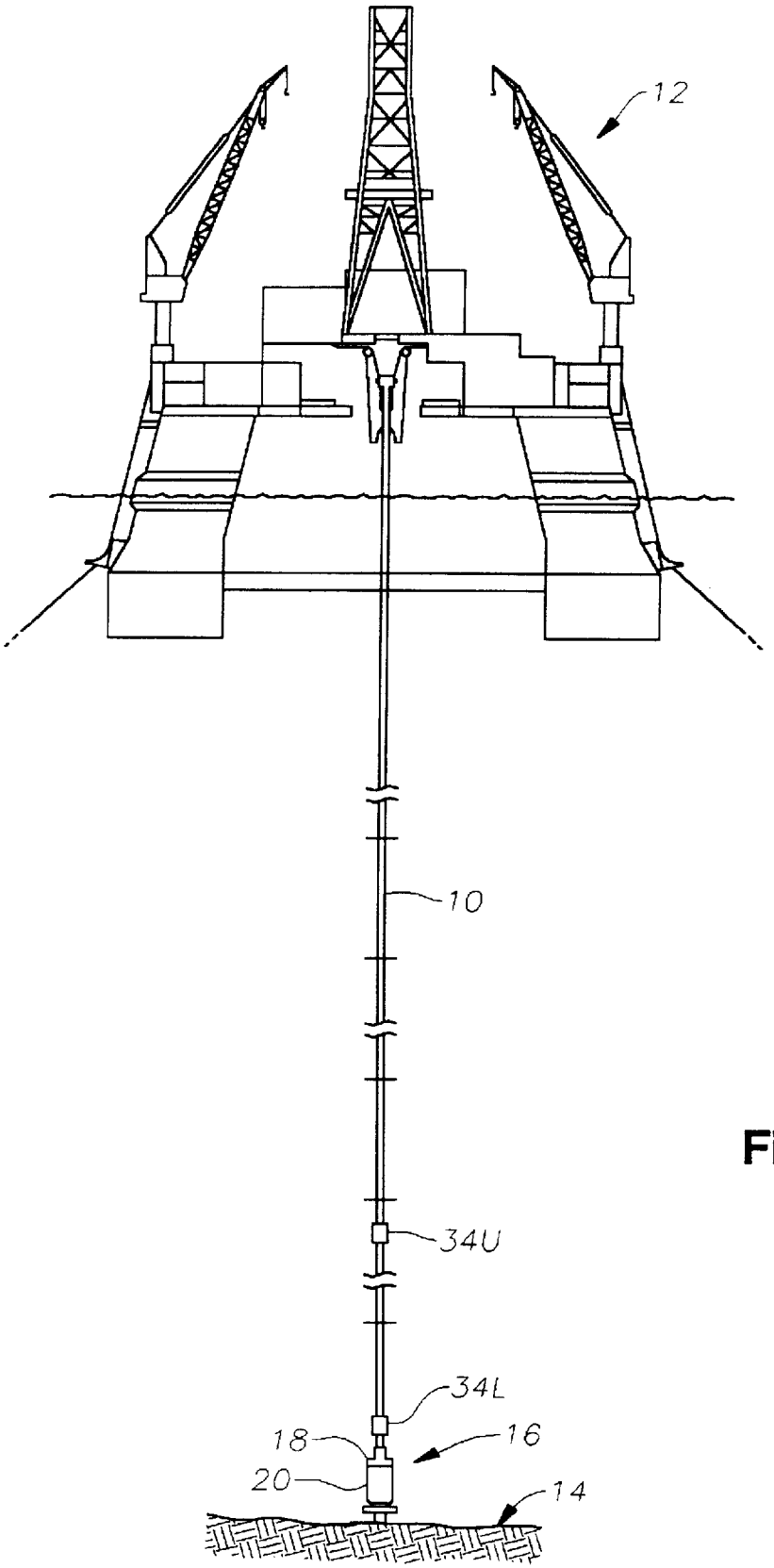
FIG. 1 is a schematic view of an offshore drilling rig with a riser string extending to a BOP that is part of a wellhead at the subsea surface.

Referring to FIG. 1, the invention is directed to a marine riser generally designated by reference numeral 10 that extends from a drilling vessel 12 to a subsea surface 14. The riser 10 is connected to a wellhead generally designated by reference numeral 16 and which includes a Lower Marine Riser Package (LMRP) 18 and a blow out preventer (BOP) 20, shown in greater detail in FIG. 2. The riser 10 is connected to the LMRP 18 through a flex joint or ball joint that is not shown in detail, but is well known in the art.

Risers are typically tensioned at the top and connected to a drilling vessel by way of a telescoping slip joint or similar device that is not shown in detail but is well known. The drilling riser 10 can be equipped with buoyancy modules (not shown) in the form of shells filled with syntactic foam or air cans in which air is either added or removed in order to adjust the buoyancy and weight of the riser 10. These buoyancy modules reduce the weight of the riser 10 as it extends from the drilling vessel 12.

The riser maintenance system and method of the present invention are designed to adjust the weight of the lower portion of the riser assembly during deployment or retrieval and other disconnect conditions that might occur during emergency situations such as a blow-out or a sudden storm. Because of the buoyancy modules, the riser 10 can have very low weight when it is being deployed or retrieved and can go into compression budding as it is run because of vertical dynamics.

Figure 2:
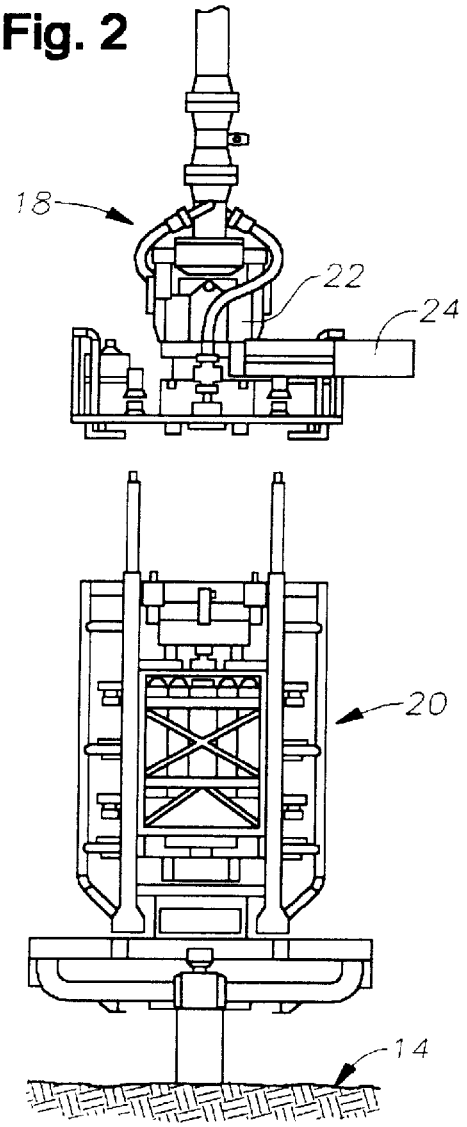
FIG. 2 is a side elevational view of an LMRP and BOP, where the LMRP is poised ready for connection with the BOP.
Figure 4:
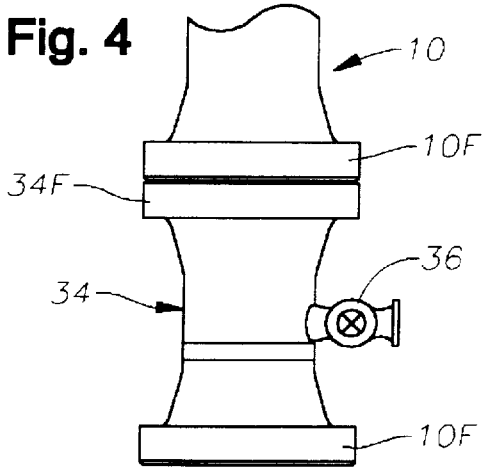
FIG. 4 is an elevational view of a joint containing a flooding valve that is mounted above the LMRP as shown in FIG. 2 and at another predetermined location along the riser.

When the riser 10 is retrieved, it is disconnected from the wellhead by removing the LMRP 18 from the BOP 20 in a known way as shown in FIG. 2.

Because of the buoyancy of the riser, more weight needs to be added to the string in order to keep the string from going into compression. This is especially true in emergency situations such as a storm where the drilling vessel 1 is subjected to heave action. The stresses on the string are more severe when it is longer, because of the large natural period of oscillation, especially when subsea well reaches depths greater than 5,000 feet, and up to and beyond 10,000 feet.

Figure 3:
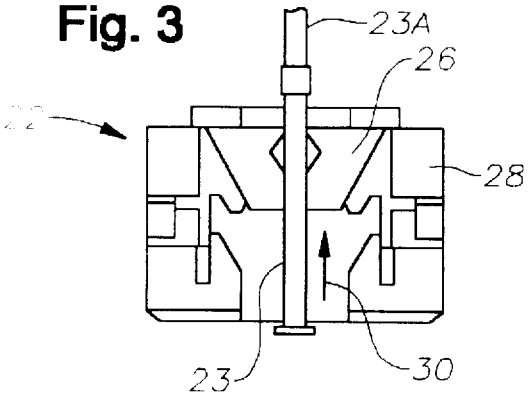
FIG. 3 is a diagrammatic view of an annular preventer that is mounted in the LMRP.

In order to adjust the weight of the riser during these conditions, several components will be utilized with the riser. One of these components is a bottom closure device, one embodiment of which, in the form of an elongated closure tool to enable closure of the annular preventer, is shown in FIG. 3 and illustrated by reference numeral 23. The well known annular preventer 22 is provided as part of the well control system. The elongated closure tool enables the annular preventer to retain drilling mud or water during deployment or retrieval of the riser 10 sufficient to add weight to the riser 10.

One way to block the riser annulus in the vicinity of the annular preventer 22, is to run a cylindrical tool 23 on the drill pipe 23A that extends through the annular preventer 22. This tool is designed to fill and seal the opening in the annular preventer 22 against positive pressure from above, when energized. The annular preventer 22 includes an annular element 26 of a known type, that can be actuated to move against the closure tool 23, and close the annular gap, by moving an actuator 28 upwardly against the element 26 in the direction of an arrow 30 as shown in FIG. 3. Actuation of the annular preventer 22 is a redundancy that can be built into the system to supplement the blocking effect of the tool 23 described below.

A blind ram, of a known type, generally illustrated by reference numeral 24, can also be provided in the LMRP 18 for blocking the riser 10, either alone or in combination with the annular preventer 22. When the blind ram 24 is provided in conjunction with the annular preventer 22, a double redundancy is added to the system, which is preferably used with an oil-based drilling mud to insure against accidental pollution.

Alternatively, a special joint (not shown) can be used in place of the blind ram 24, which can be equipped with a gate valve that is actuated remotely or by a remotely operated vehicle (ROV). All of these alternatives can be used to block the riser 10 in order to hold drilling mud or other fluid above it when the LMRP 18 is disconnected from the BOP.

The system and method also includes a pair of U-tube flooding joints generally designated by reference numeral 34 (FIG. 4) connected to the riser string 10. These joints are shown in FIG. 1 as an upper joint 34U and a lower joint 34L. The joints 34 are connected to the marine riser string 10 through flanges 10F and 34F shown in FIG. 4. The joints 34 have an annulus that is coextensive with the annulus of the riser assembly 10 and are both equipped with a valve 36 that can either be opened remotely or by an ROV depending on a design preference.

The joints 34 are provided at some point along the length of the riser 10 and directly above the LMRP 18. The location of the upper joint 34U is predetermined and is based on the particular factors relevant for that riser, such as the depth of the water, weight of the drilling string, normal water conditions and other variables. One example is to place the upper joint 34U approximately one-third the distance from the subsea surface 14 to the drilling vessel 12.

When open, the valves 36 permit draining or filling of the riser 10 by hydrostatic head (a so-called U-tube effect). When the valves are closed, they retain the drilling fluid within the portion of the riser between the two joints 34U and 34L. In this way, an amount of drilling fluid can be maintained in the lower portion of the marine riser 10 in order to add additional weight and provide the advantages discussed above.

Figure 5A:
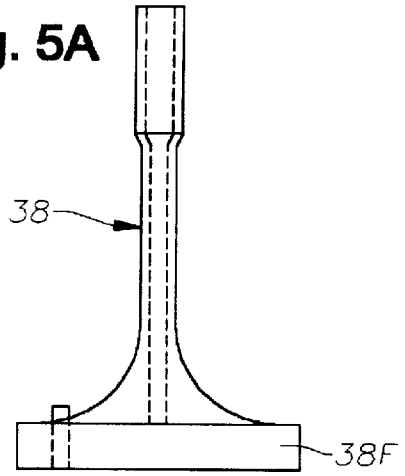
FIGS. 5A and 5B are side and top views, respectively, of an upper riser cap used in the riser management system of the present invention.
Figure 5B:
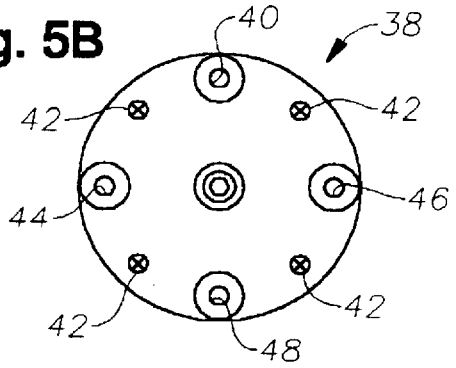

Another component of the riser management system and method is a riser cap assembly 38 shown in FIGS. 5A and 5B, which is attached at the top of the riser 10 pipe during deployment and retrieval, as described in greater detail below. When connected, the riser cap assembly 38 permits connection of the top of a mud booster line (not shown) through an opening 40, to a mud pump manifold (not shown) connected to the mud supply. This connection is well known and permits circulation from the mud manifold, through the booster line, into the annulus connected at the lower end of the riser 10, in order to displace water in the riser with drilling mud during a deployment operation and to displace mud from the riser with water during a retrieval operation, as described in greater detail below. The riser cap assembly 38 has a flange 38F for connection to a riser tubular through bolts 42. The riser cap assembly 38 also includes openings 44, 46 for accommodating choke and kill lines (not shown).

An opening 48 is also provided for hydraulic supply lines (not shown).

Figure 6A:
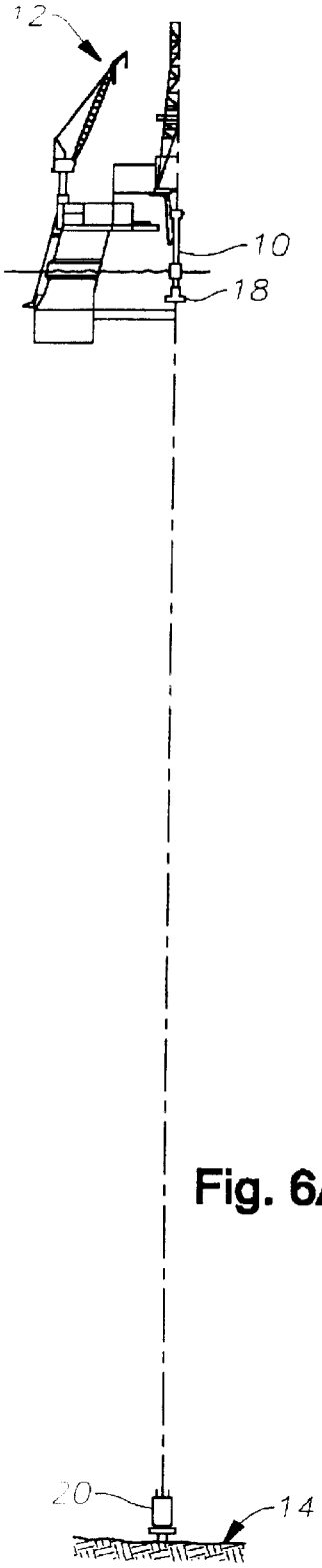
FIGS. 6A, 6B and 6C illustrate a sequence of steps for deploying a riser using the riser management system of the present invention.
Figure 6B:
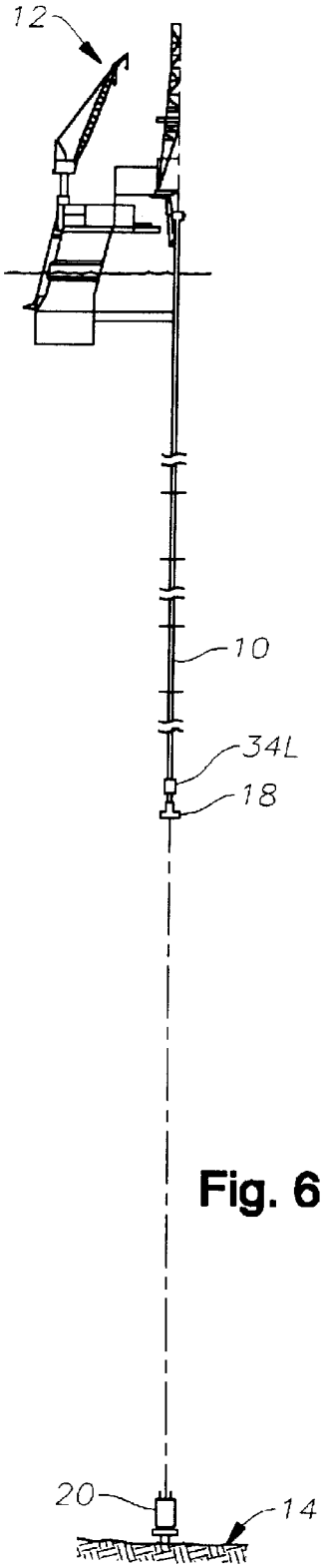
Figure 6C:
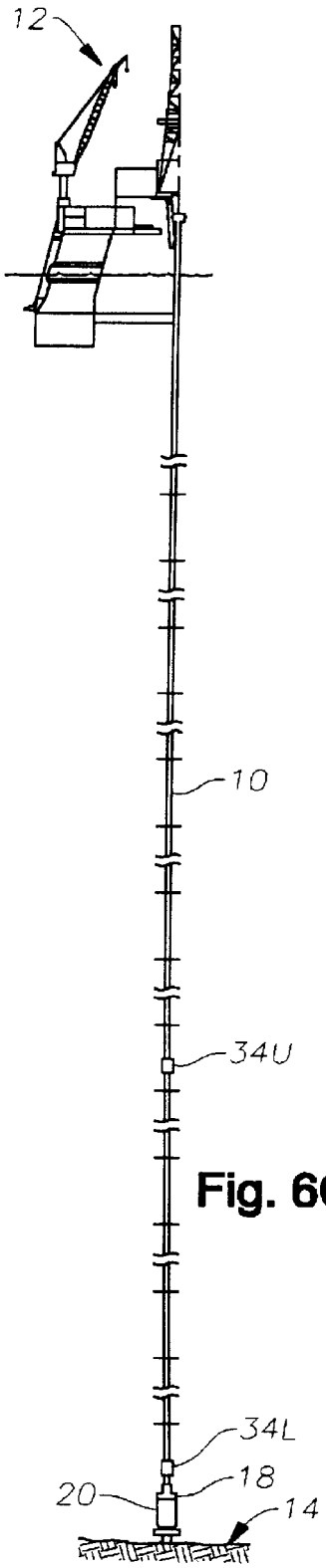

In order to better understand the invention, FIGS. 6A, 6B and 6C generally illustrate a sequence of steps during a deployment operation. As shown in FIG. 6A, an LMRP 18 is connected to a length of riser pipe 10 at the drilling vessel 12. A closure tool is inserted into the annular preventer 22, as described above, and the annular 22 is actuated to close the element 26 and block the tool. If a blind ram or gate valve (not shown) is utilized above the LMRP 18, it is also closed. In this way, the tool is blocked to prevent any fluid from flowing through it. The valve 36 in the lower flooding joint 34L is opened to allow water to flow into the riser joints as the riser string 10 is lowered.

As the riser 10 moves from the position shown in FIG. 6A to the position shown in FIG. 6B, the riser joints 10 are run in the free-flooding mode until the predetermined joint in which the upper flooding joint 34U is installed is reached. The upper joint 34U is attached and is lowered just below the drilling floor of the vessel 12. The valve 36 in the upper flooding joint 34U is in an open position at this time.

Also, at this time, the valve 36 in the lower flooding joint 34L is closed. The riser cap 38 is attached in order to connect the mud manifold to the mud booster line, on the riser 10 that has already been deployed. After the upper riser cap 38 is in place, when the riser is in the position shown in FIG. 6B, sea water in the riser 10 is displaced with drilling mud through the mud booster line by forcing the sea water through the valve 36 in the upper flooding joint 34U into the sea, until the mud level is just below the valve 36 in the upper flooding joint 34U. The riser cap 38 is removed.

The upper portion of the riser string 10 is then run in a free flooding mode, with the valve 36 in upper joint 34U open, until the string 10 reaches the position shown in FIG. 6C. During this step, the portion of the riser string 10 between the upper and lower flooding joints 34U, 34L is filled with mud and weighted to stabilize the string 10.

After the LMRP 18 is landed and connected to the BOP 20, the valve 36 in the upper flooding tool 34U is closed, either with an ROV or a hydraulically actuated valve. Open ended drill pipe (not shown) is then tripped into the riser to just above the closure tool, at which time drilling mud is pumped above the tool for filling the riser with mud and displacing water in the riser 10 overboard.

The drill pipe string (not shown) is made up into the closure tool 24 in the annular preventer 22 after a column of good mud is established. Then, the annular preventer 22 is opened and the tool is tripped out of the hole by pulling up the drill string.

Figure 7A:
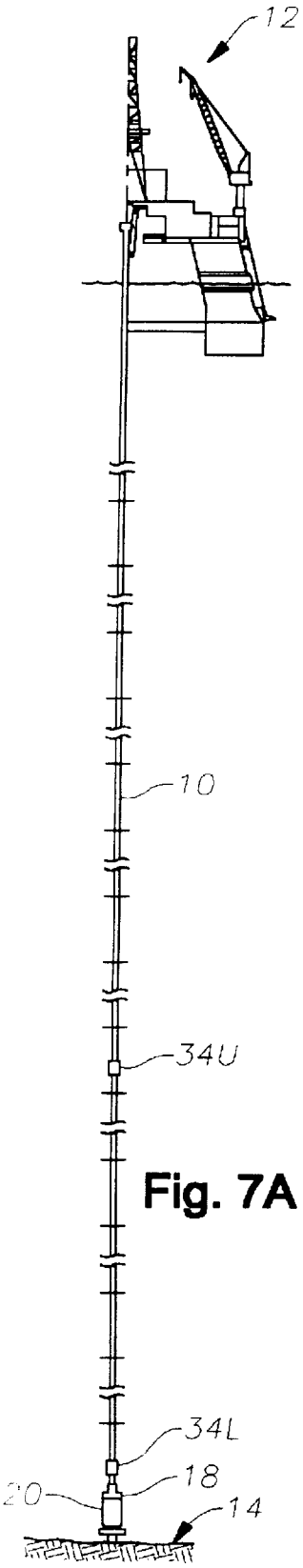
FIGS. 7A, 7B and 7C illustrate a sequence of steps for retrieving a riser using the riser management system of the present invention.
Figure 7B:
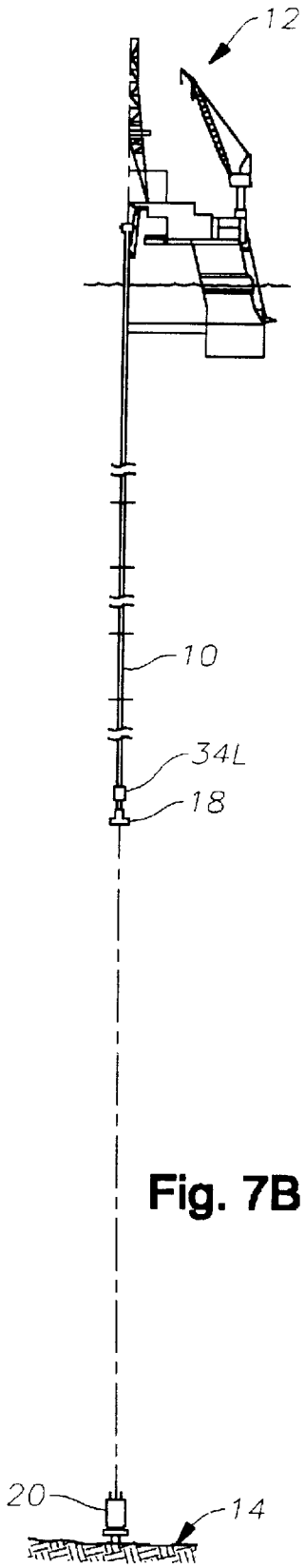
Figure 7C:
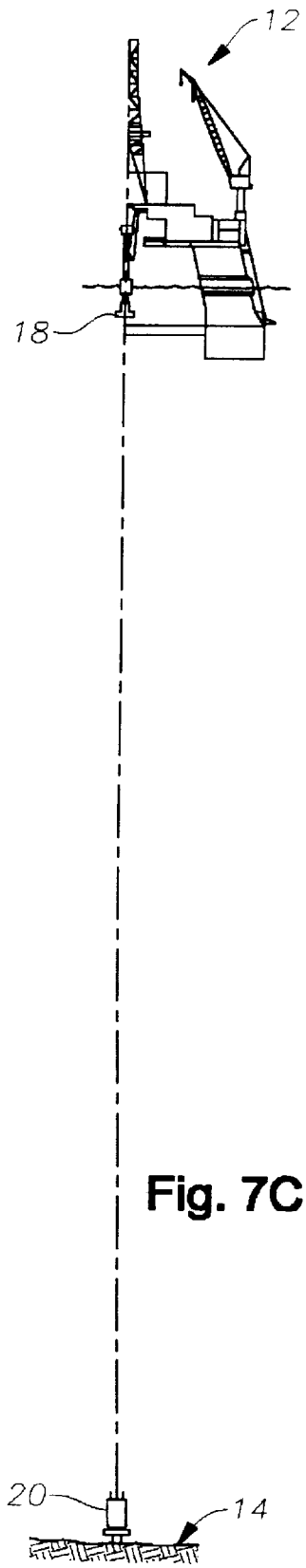

Referring to FIGS. 7A, 7B and 7C, the steps of retrieving the drill string in accordance with the present invention will be described. Referring to FIG. 7A, a closure tool is inserted into the annular preventer 22 and the element 26 is then closed, as described above. A blind ram or butterfly valve above the LMRP 18 is also closed, if one is used.

The upper riser cap 38 is connected and drilling mud in the main bore of the riser 10 above the upper flooding joint 34 is displaced with drill water by reversing the flow of drilling mud through the mud booster line back into the mud pit until the top of the mud column in the riser 10 is just below the upper flooding joint 34U. The valve 36 in the upper flooding joint 34U is opened with an ROV or through a remote hydraulic actuator. As shown in FIG. 7A, the LMRP 18 is disconnected from the BOP 20 and riser joints 10 are retrieved in a free-flooding mode until the upper flooding joint 34U has reached the drill floor of the vessel 12. During the operation, the portion of the riser string 10 between the flooding joints 34U and 34L is filled with mud and weighted to provide stability for the riser 10.

When the riser 10 is at the position shown in FIG. 7B, the valve 36 on the upper flooding joint 34U is then closed and the upper riser cap 38 is once again attached. Water is pumped into the main riser bore, displacing mud which is returned to the mud pit through the mud booster line in a reverse flow situation, until all of the mud is replaced with sea water. The valve 36 in the lower flooding joint 34L above the LMRP 18 is opened and the riser is retrieved from the position shown in FIG. 7B to the position shown in FIG. 7C in a free-flooding mode, until all of the riser is retrieved.

In an emergency situation such as, for example, during a blow-out or a sudden storm, shear/blind rams in the BOP 20 can be activated to seal the wellhead. If there is no time to run a closure tool, an optional blind ram 24 is actuated for trapping the mud in the pipe, and the LMRP 18 is disconnected from the BOP 20. At this time, the sequence of steps for retrieving the riser string 10 are conducted in order to maintain mud between the upper flooding joint 34U and the lower flooding joint 34L, except to displace the mud above the upper flooding joint 34U with sea water. Once the emergency has abated, the remaining steps of retrieval are conducted.

By using the riser management system with the tools and equipment described above, significant costs can be saved, especially in deep water situations below 5,000 feet where special equipment does not have to be used in order to safely deploy and retrieve marine riser pipe. This is done by providing two flooding valves, between which drilling mud can be maintained for adding to the weight of the lower end of the string, without adding to the weight of the marine riser 10 with mud throughout the remaining length of the riser. These operations can be performed in a relatively quick and simplified manner, which will save time and therefore operational expense during the deployment and retrieval operations.

It should be understood that exemplary embodiments of the invention have been described and that additions and modifications can be made to the invention, which fall within the spirit and scope of the invention, as defined in the appended claims, in which:

What is claimed is:

1. A system for managing the weight of an underwater riser assembly of the type that includes an annulus and top and bottom ends, during deployment or disconnect conditions, comprising:

(a) a blocking mechanism for selectively blocking the bottom end of the riser assembly;

(b) upper and lower flooding valves that are independently operable and located in spaced-apart positions in the riser assembly above the blocking mechanism, said valves being adapted to selectively operate in an open position for communicating the annulus with the surrounding water and in a closed position;

(c) a mechanism for introducing or removing heavy fluid from the annulus during various open and closed positions of the upper and lower flooding valves for introducing or removing said fluid from the annulus of the riser assembly under deployment or disconnect conditions.

2. The system of claim 1, wherein the blocking mechanism includes an elongated cylindrical tool adapted to substantially fill the annulus at the bottom end of the riser assembly for blocking the flow of fluid in said annulus.

3. The system of claim 2, wherein the blocking mechanism includes a bottom closure assembly of the bottom end of the riser assembly, and further including an annular preventer to apply pressure around the outer surface of the elongated cylindrical tool when the tool is located within the annulus.

4. The system of claim 1, wherein the blocking mechanism includes a blind ram for applying pressure to the riser assembly and preventing fluid from flowing through the bottom end.

5. The system of claim 1, wherein the lower flooding valve is mounted immediately above the blocking mechanism.

6. The system of claim 5, wherein the upper flooding valve is mounted in the riser assembly a pre-determined distance between the subsea floor and the surface of the water.

7. The system of claim 1, wherein the upper and lower flooding valves are changed from open and closed positions by a remotely operable actuator system.

8. The system of claim 1, wherein the upper and lower flooding valves are changed between their open and closed positions by a remotely operable vehicle.

9. The system of claim 1, wherein the mechanism for introducing and removing further includes a riser cap assembly with an opening adapted for connection with a mud booster line for communication with the annulus of the riser assembly, the mud booster line extending from a mud pump manifold.

10. A method for managing the weight of an underwater riser assembly of the type that includes an annulus and top and bottom ends, during deployment or disconnect conditions, comprising the steps of:

(a) providing upper and lower valves that are independently operable and located in spaced-apart positions in the riser assembly, said valves being adapted to selectively operate in an open position for communicating the annulus with the surrounding water and in a closed position;

(b) selectively blocking the annulus below the lower valve; and (c) displacing water with heavy fluid in the annulus between the first and second valves under predetermined conditions.

11. The method of claim 10, wherein the riser assembly is deployed by further including the steps of:

(a) installing the lower valve on a first riser joint and blocking the annulus below the valve;

(b) running the riser assembly with the lower valve open for a predetermined distance;

(c) installing the upper valve on the riser assembly;

(d) displacing water with heavy fluid in the annulus, with the lower valve closed and the upper valve open, until the heavy fluid reaches a point below the upper valve;

(e) running the riser assembly with the upper valve open until the bottom end of the riser assembly is connected to an underwater wellhead;

(f) displacing water with heavy fluid in the annulus above the upper valve after the upper valve is closed until a column of fluid is established; and (g) unlocking the annulus below the lower valve.

12. The method of claim 10, wherein the riser assembly is retrieved, and further including the steps of:

(a) blocking the annulus below the lower valve;

(b) displacing heavy fluid with water in the annulus above the upper valve with the upper and lower valves closed;

(c) disconnecting the riser assembly from an underground wellhead;

(d) retrieving the riser string with the upper valve open until the upper valve reaches a drilling platform;

(e) displacing the heavy fluid with water between the upper and lower valves with the upper and lower valves closed; and (f) retrieving the remaining riser assembly with the lower valve open.

13. The method of claim 10, wherein the riser assembly is disconnected from a wellhead in an emergency situation, further comprising the steps of:

(a) blocking the annulus below the lower valve;

(b) disconnecting the riser from the wellhead; and (c) displacing heavy fluid with water in the annulus above the upper valve with the upper and lower valves closed.

* * * * *